US010879650B2

(12) United States Patent
Lin

(10) Patent No.: US 10,879,650 B2
(45) Date of Patent: Dec. 29, 2020

(54) ELECTRICAL CONNECTOR

(71) Applicant: LOTES CO., LTD, Keelung (TW)

(72) Inventor: Chin Chi Lin, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 16/705,439

(22) Filed: Dec. 6, 2019

(65) Prior Publication Data

US 2020/0185863 A1 Jun. 11, 2020

(30) Foreign Application Priority Data

Dec. 11, 2018 (CN) ..... 2018 1 1506954

(51) Int. Cl.
*H01R 13/6586* (2011.01)
*H01R 13/08* (2006.01)
*H01R 107/00* (2006.01)

(52) U.S. Cl.
CPC ..... *H01R 13/6586* (2013.01); *H01R 13/08* (2013.01); *H01R 2107/00* (2013.01); *H01R 2201/06* (2013.01)

(58) Field of Classification Search
CPC ..... H01R 13/6586; H01R 13/08; H01R 2107/00; H01R 2201/06; H01R 12/57; H01R 13/6594; H01R 13/6587; H01R 13/405; H01R 13/627; H01R 13/629; H01R 13/6585; H01R 13/2435; H01R 12/52; H01R 12/62; H01R 12/716
USPC ..... 439/607.05, 607.06, 607.07, 607.23, 439/65–69, 74
See application file for complete search history.

(56) References Cited

U.S. PATENT DOCUMENTS 5,772,451 A 6/1998 Dozier, II et al.
6,152,747 A * 11/2000 McNamara ..... H01R 13/6587 439/108
7,959,466 B2 6/2011 Ju
8,944,831 B2 * 2/2015 Stoner ..... H01R 13/6587 439/108
9,570,857 B2 * 2/2017 Morgan ..... H01R 13/6585
2003/0119362 A1 * 6/2003 Nelson ..... H01R 12/716 439/607.07
2007/0207635 A1 * 9/2007 Gailus ..... H01L 23/49811 439/74
2009/0017698 A1 * 1/2009 Ju ..... H01R 9/223 439/709

(Continued)

FOREIGN PATENT DOCUMENTS

CN 202034628 U 11/2011
CN 103872501 B 3/2016

(Continued)

*Primary Examiner* — Travis S Chambers
(74) *Attorney, Agent, or Firm* — Locke Lord LLP; Tim Tingkang Xia, Esq.

(57) ABSTRACT

An electrical connector includes: a substrate; multiple rows of conductive terminals electrically connected to the substrate respectively; multiple insulators; and multiple shielding bodies electrically connected to the substrate. Each insulator is correspondingly attached to one of the rows of the conductive terminals. The shielding bodies are located between two adjacent rows of the conductive terminals and correspondingly fixed on the insulators. Therefore, a shielding effect thereof is good, and electromagnetic interference between the two adjacent rows of conductive terminals can be effectively shielded.

10 Claims, 12 Drawing Sheets

(56) References Cited

U.S. PATENT DOCUMENTS

2014/0162471 A1* 6/2014 Hwang ..... H01R 13/6586
439/65

FOREIGN PATENT DOCUMENTS

CN 103117486 B 12/2016
CN 107093827 A 8/2017

* cited by examiner

100

100

ELECTRICAL CONNECTOR

CROSS-REFERENCE TO RELATED PATENT APPLICATION

This non-provisional application claims priority to and the benefit of, pursuant to 35 U.S.C. § 119(a), patent application Serial No. CN201811506954.4 filed in China on Dec. 11, 2018. The disclosures of the above applications are incorporated herein in their entireties by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and in particular to an electrical connector that can reduce electromagnetic interference between two adjacent rows of conductive terminals.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

An electrical connector is widely used in electronic fields such as computers due to its stable electrical performance. A computing core, that is, a central processing unit (CPU) therein, needs to be coupled to a main board through the electrical connector. With rapid development of computer technologies, the quantity of CPU cores increases and doubles, and a CPU needs more conductive terminals to be used for signal transmission, resulting in a very tight arrangement between multiple conductive terminals. Consequently, it is likely to generate signal interference between the plurality of conductive terminals. Therefore, in the industry, a shielding structure for suppressing electromagnetic interference is generally provided around the conductive terminals. For example, the Chinese Patent No. 201210389733.X discloses an electrical connector, including a substrate, a plurality of conductive terminals arranged in a matrix being soldered to an upper surface of the substrate for connecting a chip module, and a socket frame located above the substrate. An accommodation space exists in a middle of the socket frame, and the conductive terminals are located in the accommodation space. Further, metal sheets assembled in an interleaved manner to form a grid are provided in the accommodation space and fixed on the socket frame to block interference between two adjacent conductive terminals. However, the accommodation space only accommodates the conductive terminals and the metal sheets respectively shielding the adjacent ones of the conductive terminals. When the chip module is pressed downward, an elastic arm of each conductive terminal is pressed downward to extend forward, and the conductive terminals may likely be in contact with the metal sheets due to relatively small gaps between the conductive terminals and the metal sheets, resulting in lap short-circuiting. If the gaps between the conductive terminals are enlarged, the conductive terminals are not likely to be in contact with the metal sheets. However, it is not conducive to densification of conductive terminals. In addition, the socket frame needs to be provided to fix the metal sheets, so a structure is complex and costs are relatively high.

Therefore, a heretofore unaddressed need to design a new electrical connector exists in the art to address the aforementioned deficiencies and inadequacies.

SUMMARY

The present invention is directed to an electrical connector that has a good shielding effect without causing short-circuiting between a conductive terminal and a shielding body.

In order to achieve the foregoing objective, the present invention adopts the following technical solutions:

An electrical connector includes: a substrate; a plurality of rows of conductive terminals, electrically connected to the substrate respectively; a plurality of insulators, wherein each of the insulators is correspondingly attached to one of the rows of the conductive terminals; and a plurality of shielding bodies, electrically connected to the substrate, wherein the shielding bodies are located between two adjacent rows of the rows of the conductive terminals and correspondingly fixed on the insulators.

In certain embodiments, the shielding bodies are located between plate surfaces of the two adjacent rows of the conductive terminals.

In certain embodiments, an upper surface of the substrate is provided with a solder point area, a plurality of solder points are arranged in the solder point area, and each of the conductive terminals is soldered to one of the solder points through a first solder; each of the shielding bodies is electrically connected to a second solder, and the second solder is located between the solder point area and an edge of the substrate.

In certain embodiments, two shielding bodies of the shielding bodies are located at two opposite sides of each of the rows of the conductive terminals, and the two shielding bodies are both soldered to a same solder to be soldered to an upper surface of the substrate.

In certain embodiments, a metal wire is correspondingly in contact with the shielding bodies, and the metal wire is soldered to an upper surface of the substrate.

In certain embodiments, the metal wire is in contact with a plate surface of each of the shielding bodies.

In certain embodiments, each of the conductive terminals has a soldering portion soldered to an upper surface of the substrate, each of the shielding bodies has a soldering leg soldered to the upper surface of the substrate, and the soldering portion is parallel to the soldering leg.

In certain embodiments, the conductive terminals comprise a ground terminal, and the shielding bodies and the ground terminal are both soldered to a same solder.

In certain embodiments, the conductive terminals, the shielding bodies, and the insulators are all flat and are parallel to each other.

In certain embodiments, each of the conductive terminals has an elastic arm, and the insulators covering the elastic arm such that the shielding bodies shield the elastic arm.

Compared with the related art, the electrical connector according to certain embodiments of the present invention have the following beneficial effects.

Each of the shielding bodies is located between two adjacent rows of the conductive terminals, such that a shielding effect thereof is good, and electromagnetic interference between two adjacent rows of the conductive terminals can be effectively shielded. Further, the shielding bodies and the conductive terminals are separated by the insulators, such that short-circuiting between the conductive terminals and the shielding bodies can be avoided. In addition, the shielding bodies are fixed on the insulators, and the insulators are attached to one row of the conductive terminals, such that no additional components are required to fix the shielding bodies and the insulators, thereby reducing costs.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
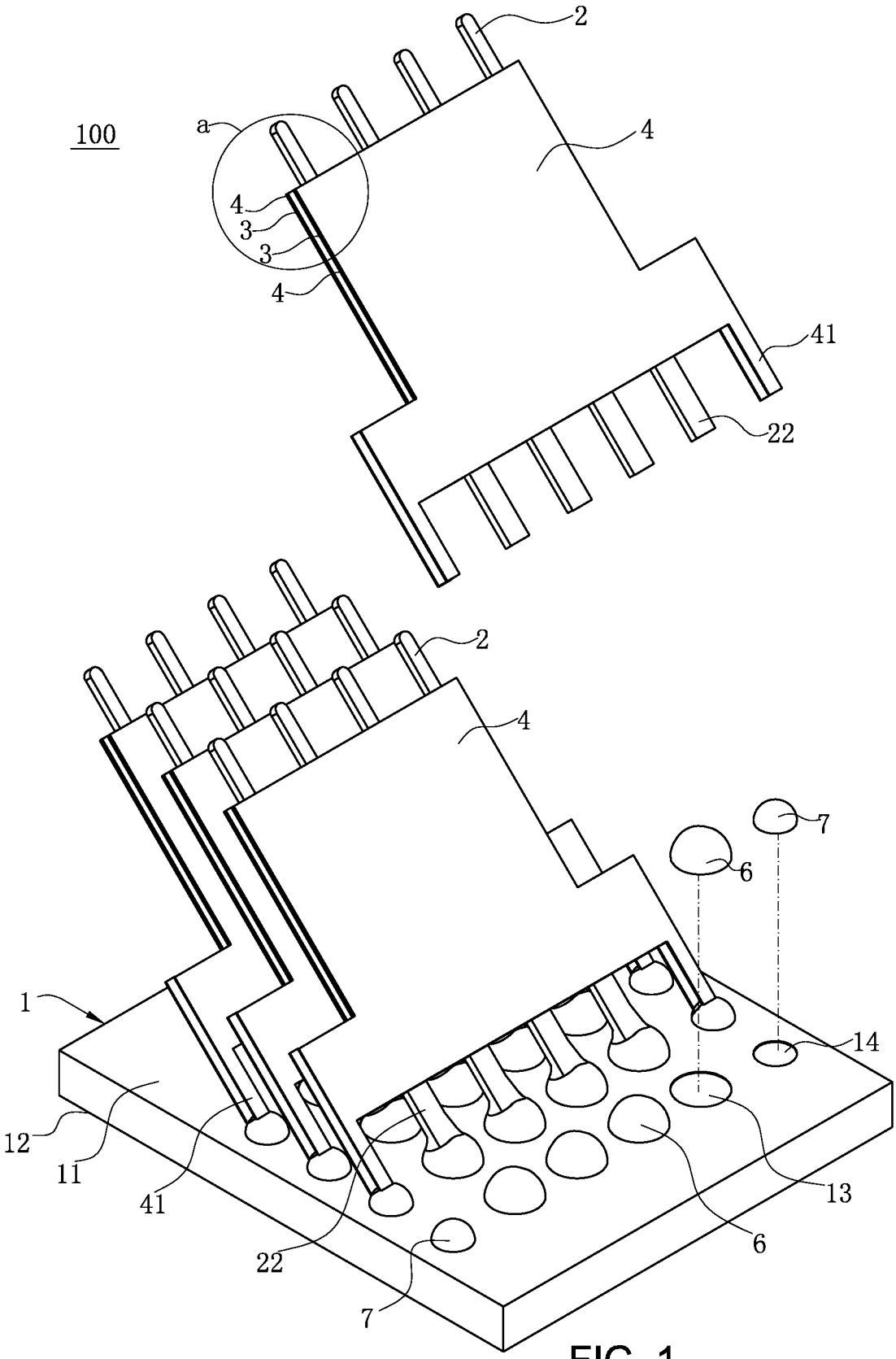
FIG. 1 is a partial schematic exploded view of an electrical connector according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-12. In accordance with the purposes of this invention, as embodied and broadly described herein, this invention, in one aspect, relates to an electrical connector.

Figure 2:
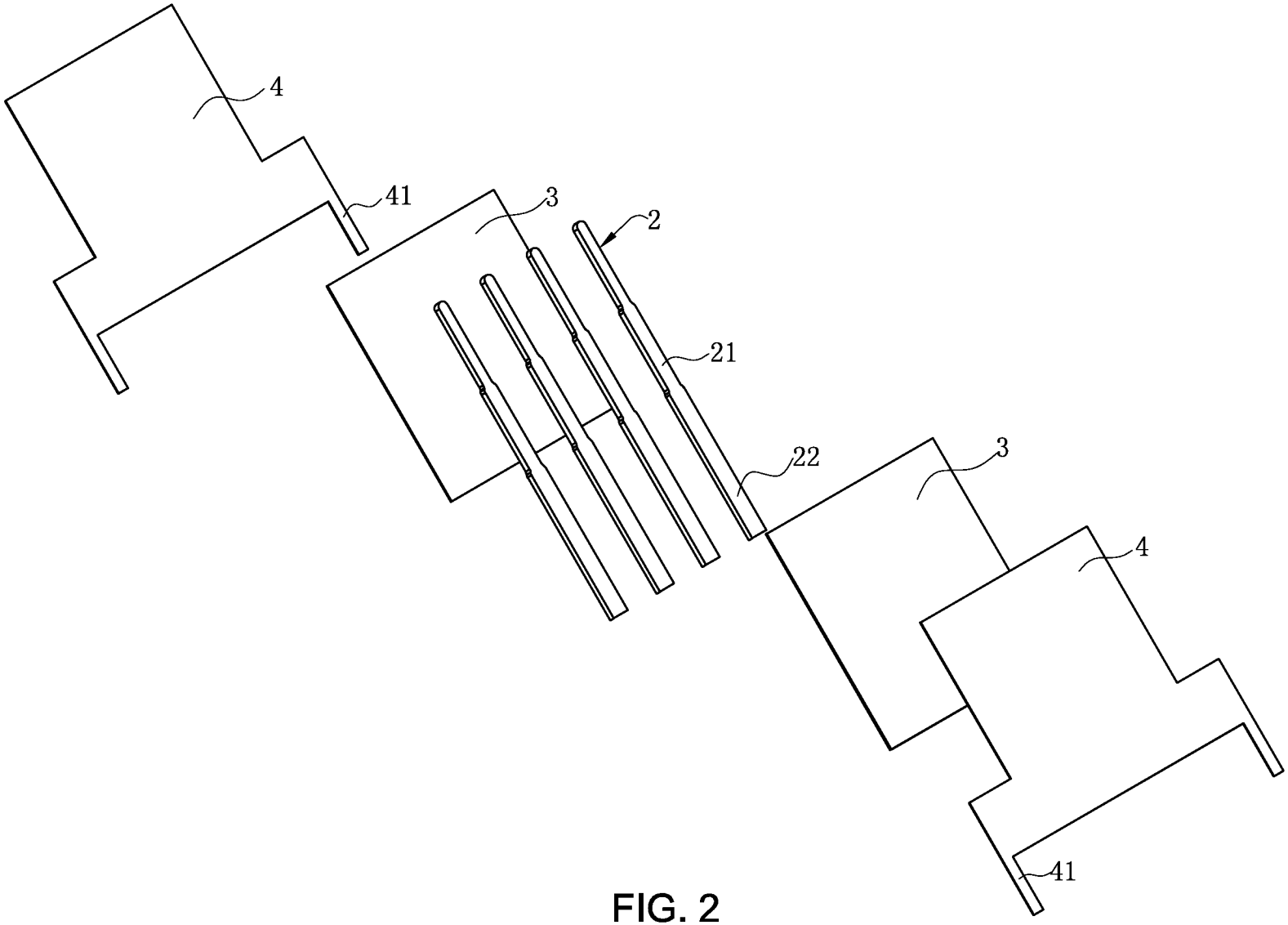
FIG. 2 is a schematic exploded view of a row of conductive terminals, an insulator, and a shielding body in FIG. 1.
Figure 3:
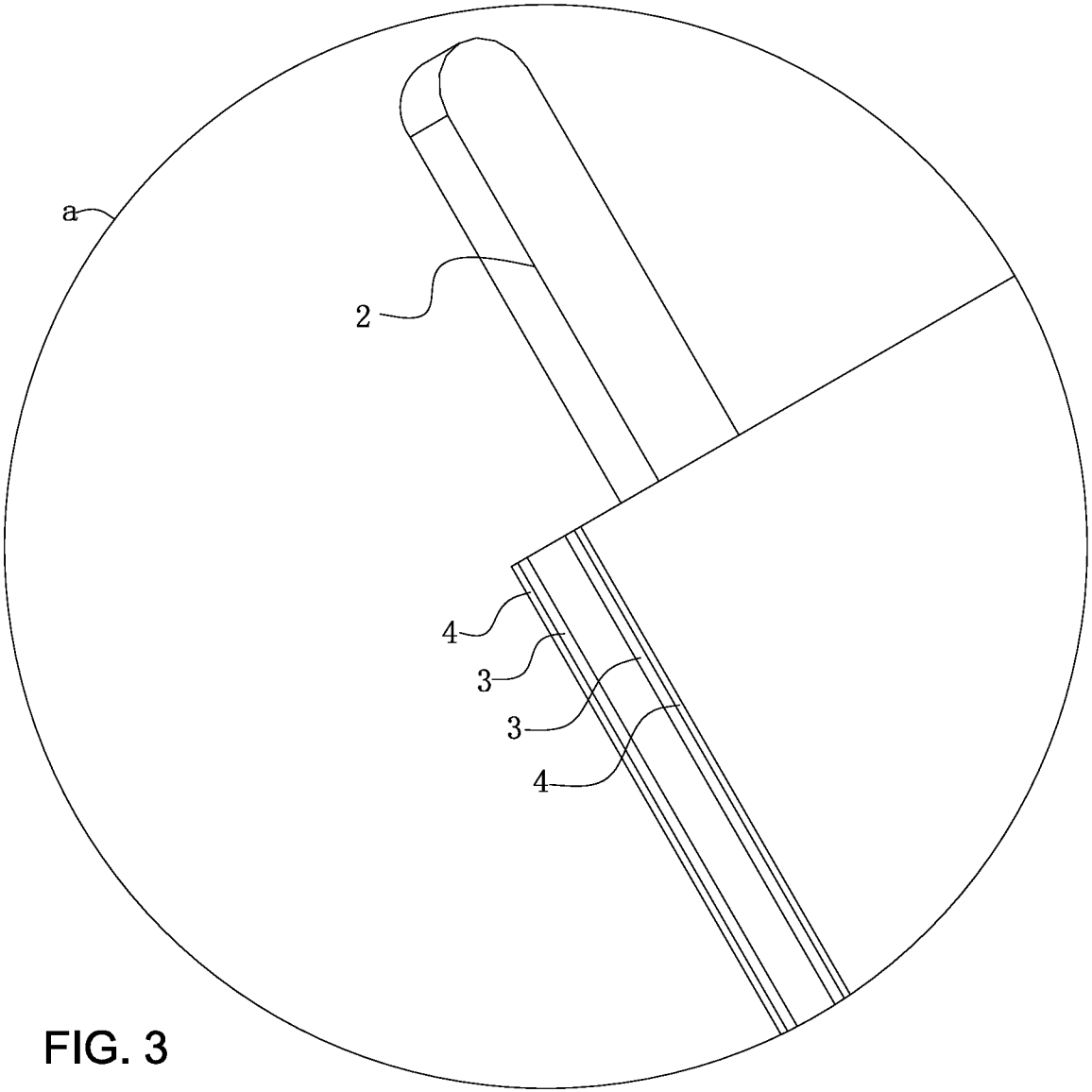
FIG. 3 is a partial enlarged view of a portion a in FIG. 1.

FIG. 1 to FIG. 3 show an electrical connector 100 according to a first embodiment of the present invention, which is used to electrically connect a chip module (not shown) to a main board 200. The electrical connector 100 includes a substrate 1, a plurality of rows of conductive terminals 2 (that is, there may be two rows or more than two rows of the conductive terminals 2) electrically connected to the substrate 1 and upward abutting the chip module; a plurality of insulators 3, where each of the insulators 3 is correspondingly attached to one row of the conductive terminals 2; and a plurality of shielding bodies 4 electrically connected to the substrate 1. The shielding bodies 4 being correspondingly fixed on the insulator 3 and located between two adjacent rows of the conductive terminals 2 to avoid electromagnetic interference between the two adjacent rows of the conductive terminals 2.

Figure 6:
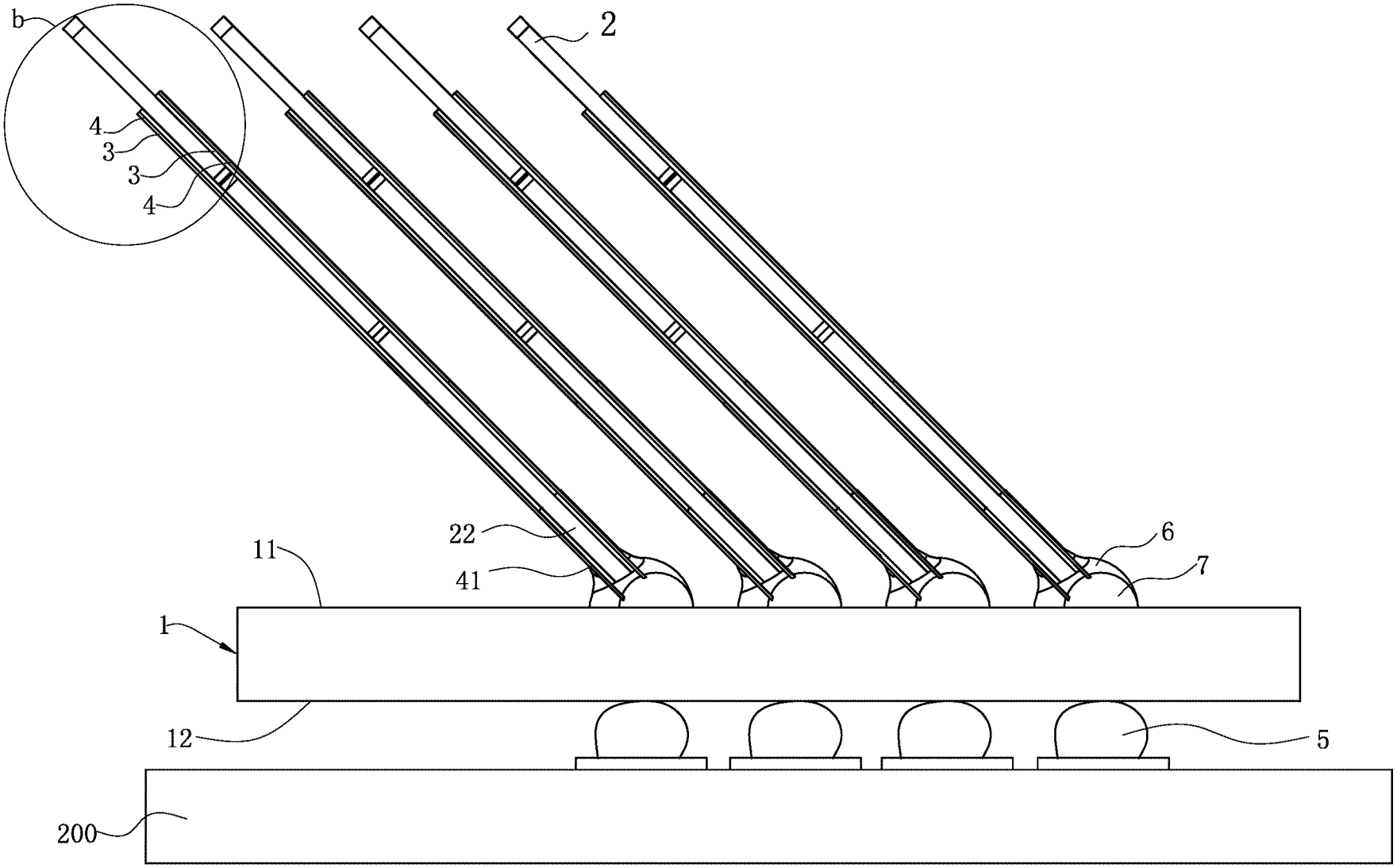
FIG. 6 is a side view of an electrical connector of FIG. 4 being soldered to a main board.

As shown in FIG. 1 and FIG. 6, the substrate 1 is a circuit board (and certainly the substrate 1 is not limited thereto in other embodiments), and has an upper surface 11. The upper surface 11 is provided with a solder point area, and a plurality of solder points 13 are arranged in the solder point area. The upper surface 11 further has a plurality of pads 14 located between the solder point area and an edge of the substrate 1. A plurality of solder balls 5 are fixed on a lower surface 12 of the substrate 1 to be soldered to the main board 200, such that the substrate 1 is electrically connected to the main board 200.

As shown in FIG. 1 to FIG. 3, each conductive terminal 2 is flat plate shaped (and certainly, in other embodiments, each conductive terminal 2 may also be bent), and each conductive terminal 2 has an elastic arm 21. A top end of the elastic arm 21 runs upward beyond the corresponding insulator 3 to upward abut the chip module. When the chip module downward abuts the elastic arm 21, the elastic arm 21 is elastically deformed. A soldering portion 22 extends downward from the elastic arm 21. The soldering portion 22 is soldered to the substrate 1 through a first solder 6, so as to fix the conductive terminal 2 and enable the conductive terminal 2 to be electrically connected to the substrate 1. In other embodiments, the conductive terminal 2 may also be inserted into the substrate 1 or otherwise electrically connected to the substrate 1.

As shown in FIG. 1 to FIG. 3, each insulator 3 is flat plate shaped and is parallel to the conductive terminals 2. Each insulator 3 is correspondingly attached to one row of the conductive terminals 2, such that the insulator 3 moves with the row of the conductive terminals 2 attached thereto. The insulator 3 covers a majority of an area of each conductive terminal 2, and covers the elastic arm 21 from an upper side of the soldering portion 22, such that the shielding bodies 4 shields the elastic arm 21. When the chip module downward abuts the elastic arm 21, the insulators 3 and the shielding bodies 4 can be both elastically deformed with the elastic arm 21. Thus, the insulators 3 can be made of a flexible material, and the shielding bodies 4 have relatively good elasticity. The insulators 3 may be formed by a liquid crystal polymer (LCP) plastic film, which is adhered to one row of the conductive terminals 2 using adhesive glue. In other embodiments, the insulators 3 may also be formed by Mylar. Mylar is an insulating material and is adhesive at a high temperature, and may be directly adhered to one row of the conductive terminals 2. The insulators 3 may also be formed by elastic rubber or the like. The insulators 3 may also cover a periphery of each conductive terminal 2, and the insulators 3 may not cover the elastic arm 21. Two plate surfaces of each conductive terminal 2 are both provided with the insulator 3.

Figure 4:
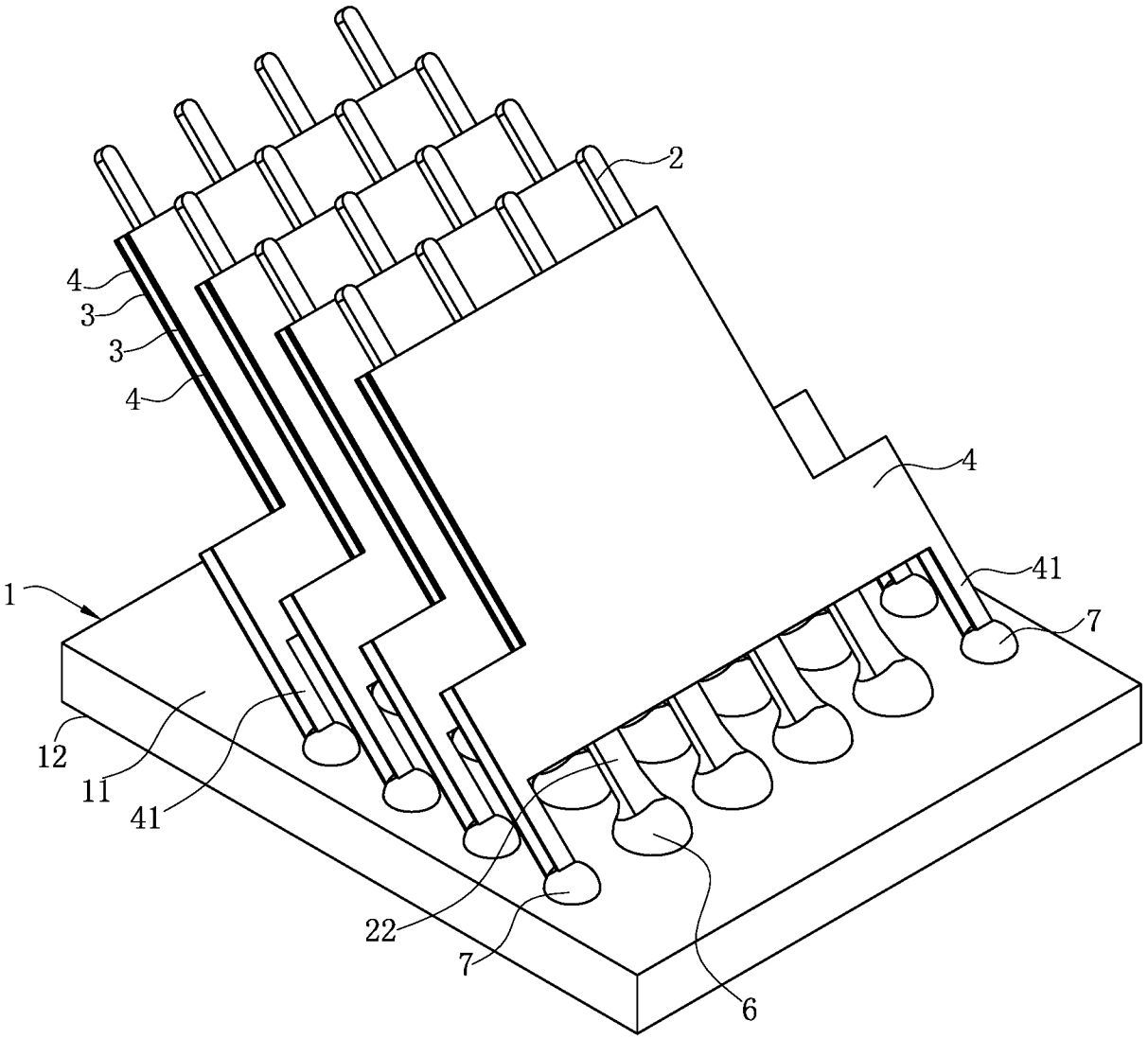
FIG. 4 is a schematic assembled view of an electrical connector according to the first embodiment of the present invention.
Figure 5:
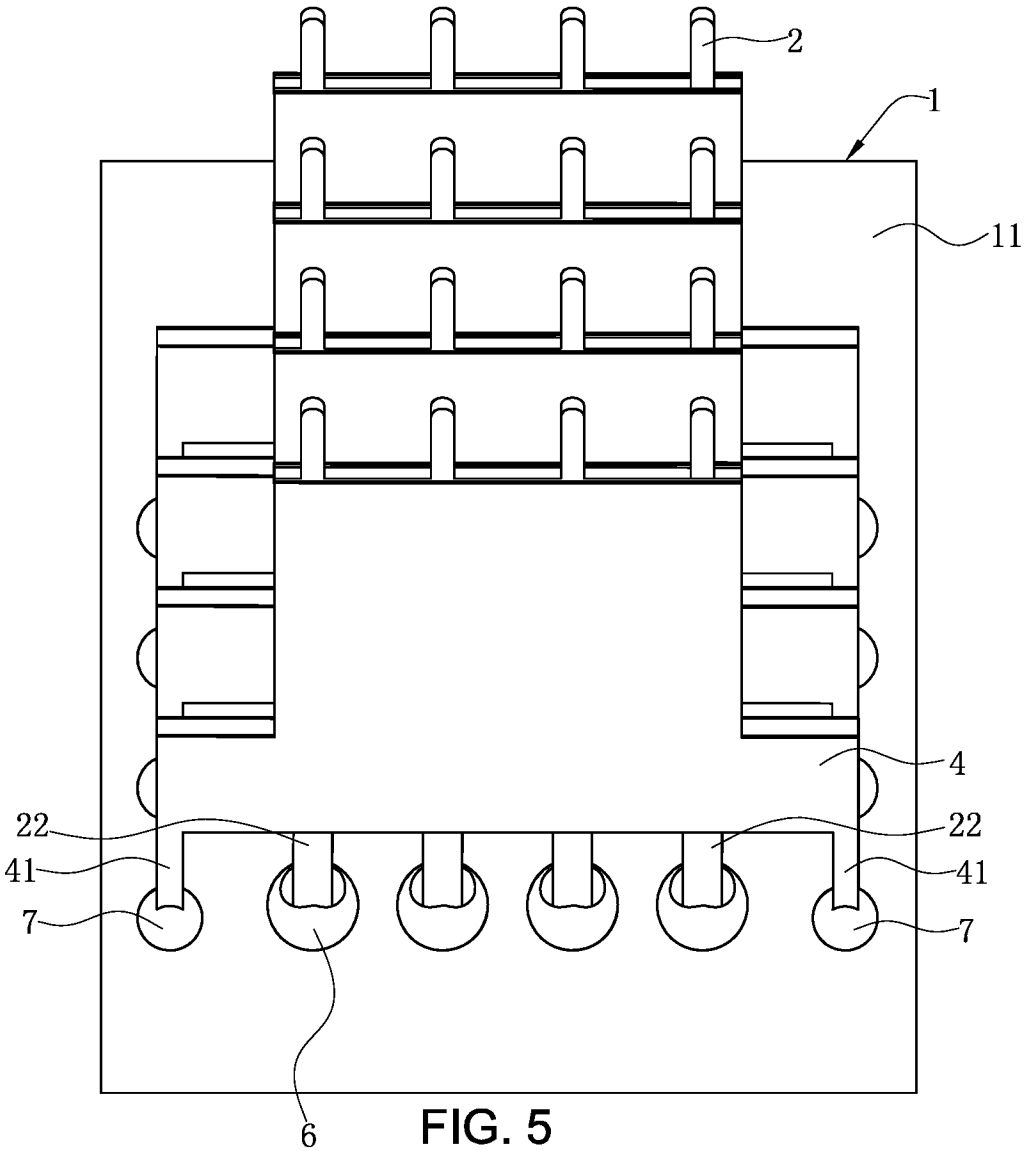
FIG. 5 is a schematic top view of FIG. 4.

As shown in FIG. 2 and FIG. 4 to FIG. 5, the shielding bodies 4 are also flat plate shaped and are located between plate surfaces of two adjacent rows of conductive terminals 2 (and certainly, in other embodiments, the shielding body 4 may also be located between plate edges of two adjacent rows of the conductive terminals 2, and may not be flat plate shaped). A plate surface of each shielding body 4 correspondingly shields plate surfaces of one row of the conductive terminals 2, and the plate surface of each shielding body 4 is parallel to the plate surfaces of the conductive terminals 2. Two opposite sides of each shielding body 4 have two soldering legs 41 respectively soldered to the pads 14 through a second solder 7, so as to ground the shielding body 4. The second solder 7 and the corresponding first solder 6 are arranged in a row. The soldering legs 41 are parallel to the soldering portions 22. Left and right sides of each row of the conductive terminals 2 have two shielding bodies 4, and the soldering legs 41 of the two shielding bodies 4 are soldered to the same second solder 7. As shown in FIG. 6, the shielding body 4 located at the left side of the corresponding conductive terminal 2 does not exceed a horizontal distance from a top end to a bottom end of the corresponding conductive terminal 2, such that a distance between two adjacent rows of the conductive terminals 2 can be effectively reduced, thereby densifying the conductive terminals 2. The shielding bodies 4 shield the elastic arm 21. In this embodiment, the insulators 3 are formed by Mylar, and the shielding bodies 4 are formed by copper layers formed on the Mylar. In other embodiments, the shielding bodies 4 may also be formed by other metal layers plated on the insulators 3, and the shielding bodies 4 may also be copper plates adhered to the insulators 3 using adhesive glue. The shielding bodies 4 may also not shield the elastic arm 21, and the shielding bodies 4 may also shield the periphery of the conductive terminals 2.

During assembly, a shielding body 4 is first fixed on an insulator 3, and then the insulator 3 is fixed on one row of the conductive terminals 2, such that the shielding body 4 and the insulator 3 both move with one row of the conductive terminals 2 attached thereto. Then, the solder points 13 are brushed with a layer of the first solder 6, and the pads 14 are brushed with a layer of the second solder 7. Then, one row of the conductive terminals 2 on which the insulator 3 and the shielding body 4 have been fixed are grasped using a terminal soldering instrument, and then the soldering portions 22 of the conductive terminals 2 are correspondingly placed at the positions of the solder points 13, and the soldering legs 41 of the shielding body 4 are corresponding placed at the positions of the pads 14. Then, the first solders 6 and the second solders 7 are heated to be melted, in order to solder the conductive terminals 2 to the first solders 6 and solder the soldering legs 41 to the second solders 7.

Figure 7:
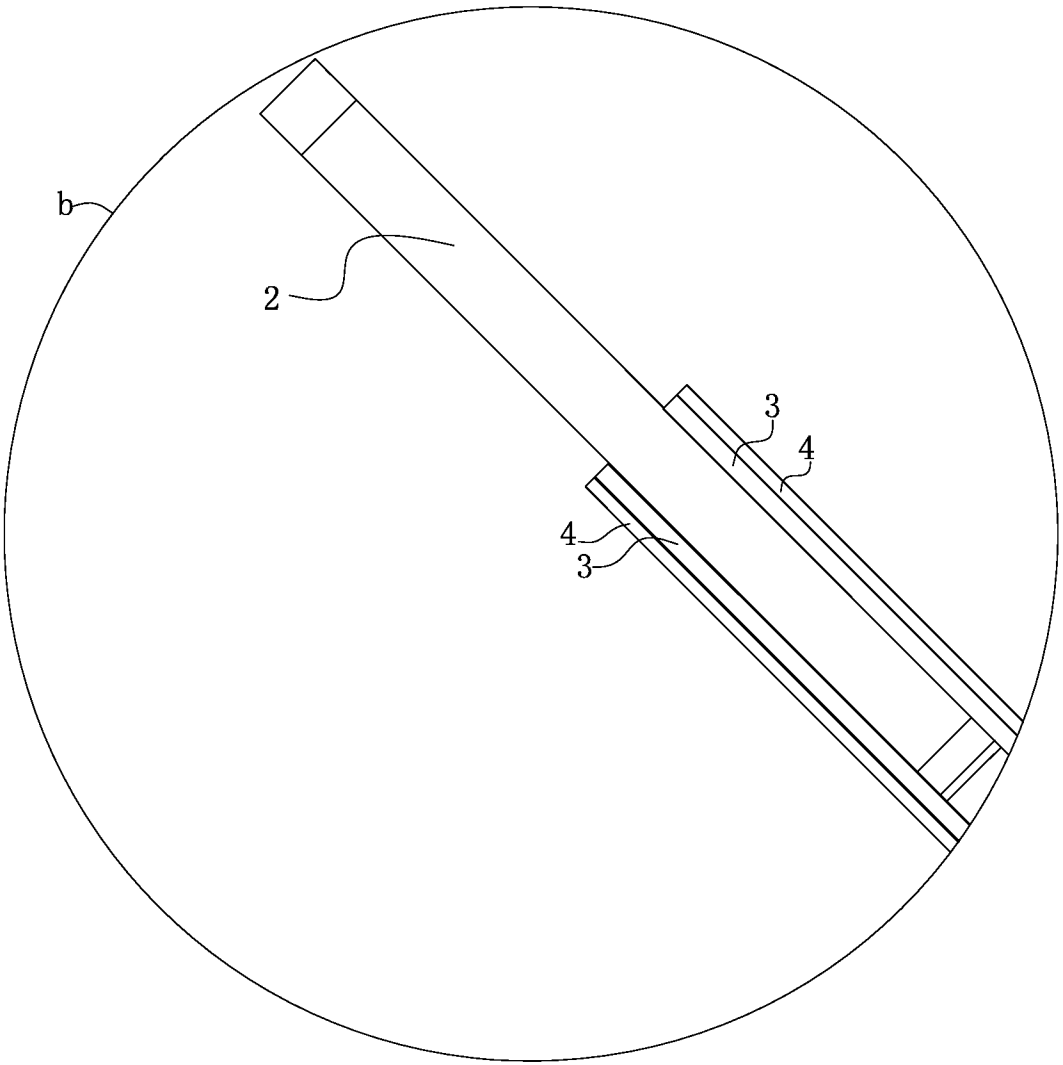
FIG. 7 is a partial enlarged view of a portion b in FIG. 6.
Figure 8:
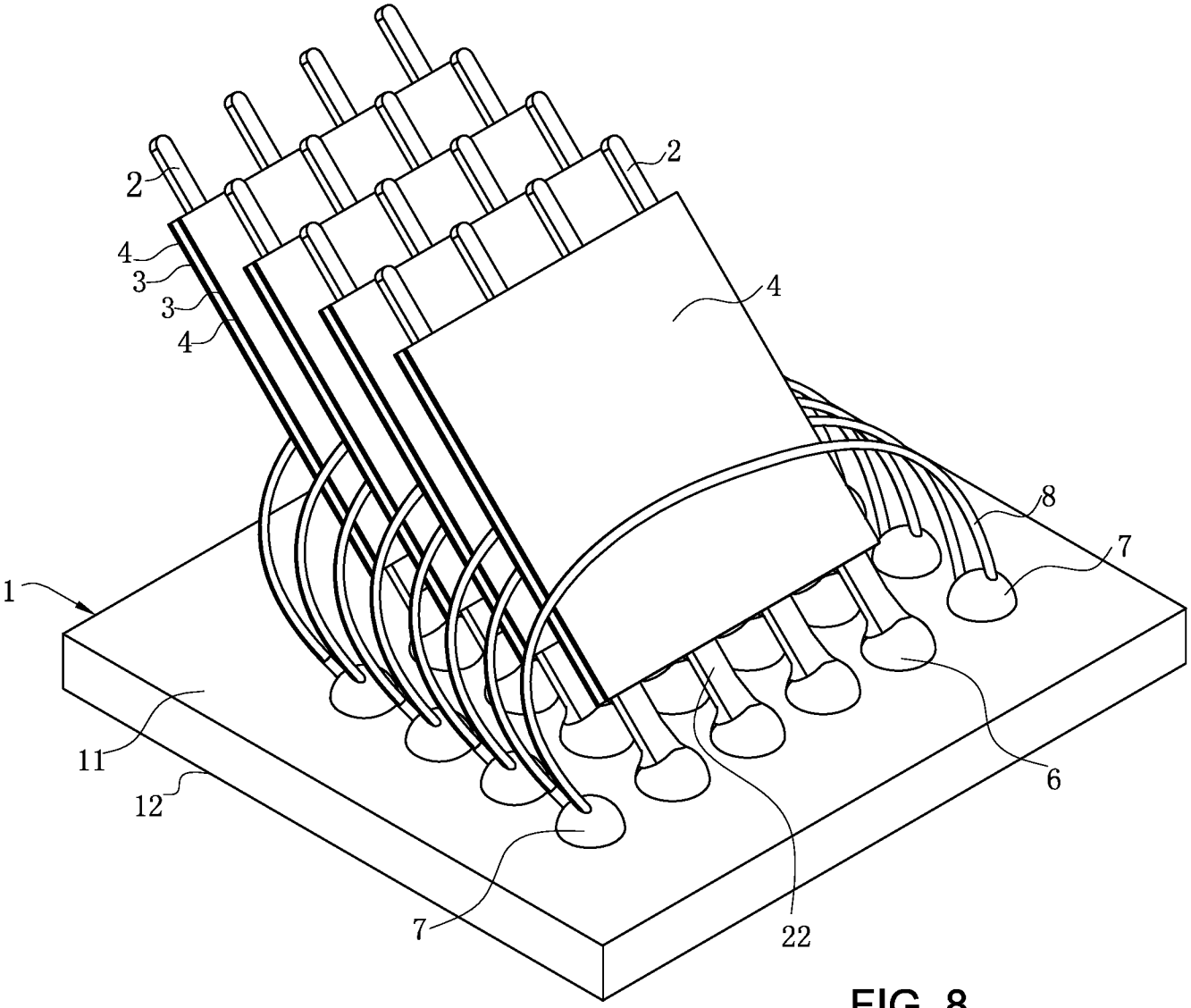
FIG. 8 is a schematic assembled view of an electrical connector according to a second embodiment of the present invention.

FIG. 6 to FIG. 8 show an electrical connector 100 according to a second embodiment of the present invention, which is different from the first embodiment in that, the shielding bodies 4 are electrically connected to the substrate 1 through a metal wire 8 to achieve grounding. The metal wire 8 is correspondingly in contact with the plate surface of each shielding body 4, and the metal wire 8 is parallel to the plate surface of each shielding body 4 to keep full contact between the metal wire 8 and the shielding bodies 4. Both ends of the metal wire 8 are soldered to the pads 14 using the second solder 7 to ground the shielding bodies 4. Two metal wires 8 on both sides of each row of the conductive terminals 2 are soldered to the same pad 14 using the same second solder 7. Other structures of the second embodiment are the same as those of the first embodiment, and are not further elaborated herein.

Figure 9:
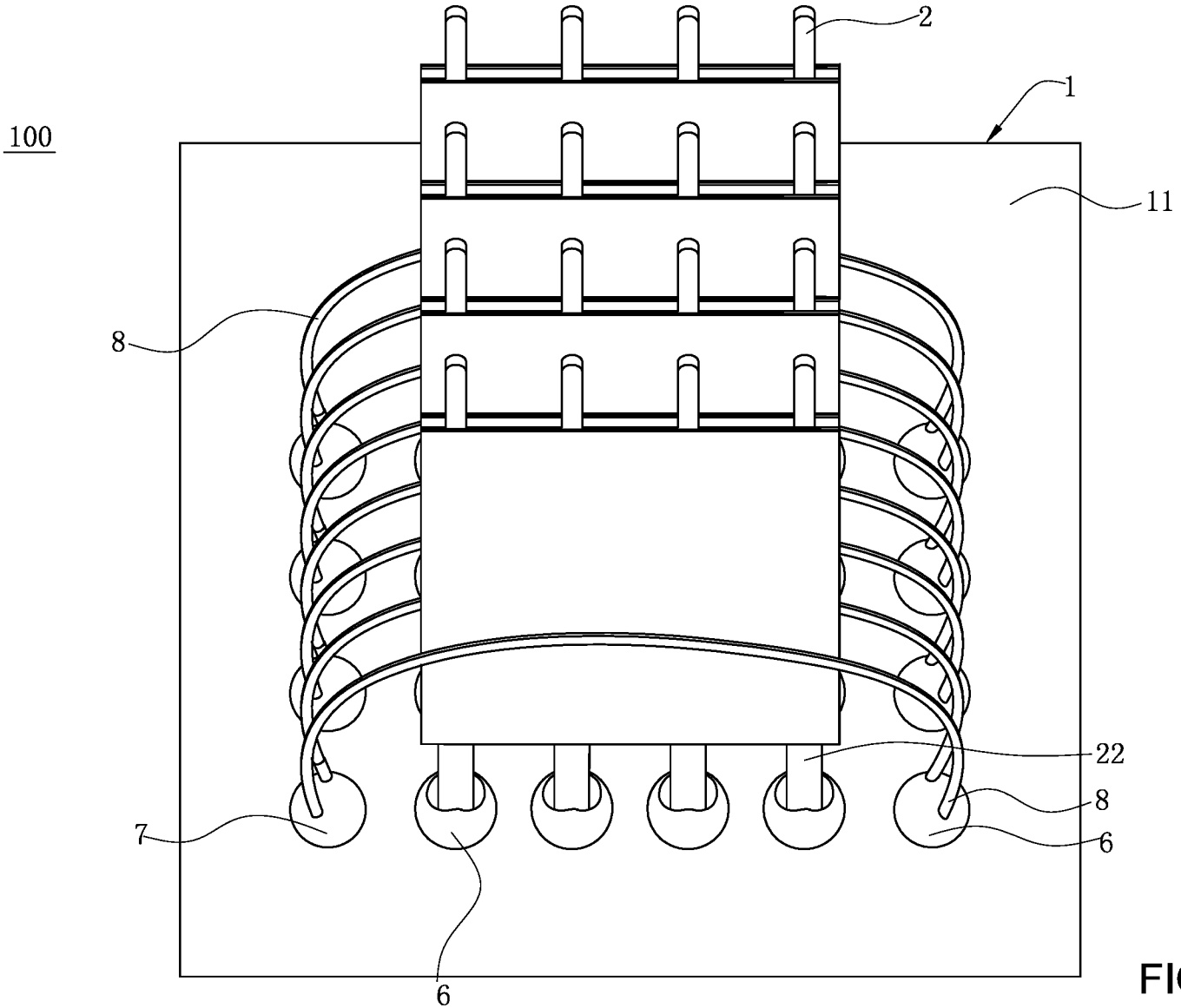
FIG. 9 is a schematic top view of FIG. 8.
Figure 10:
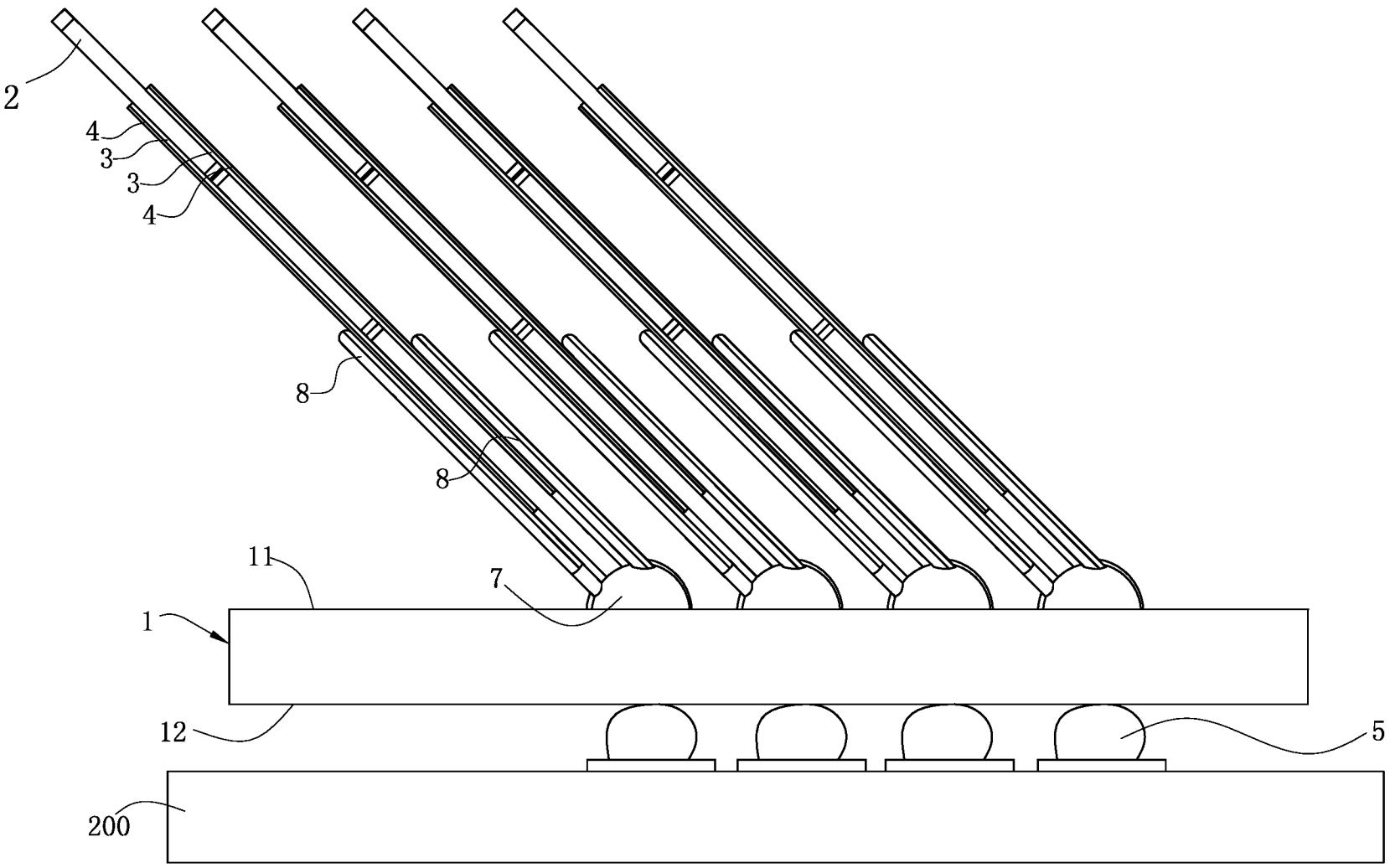
FIG. 10 is a side view of an electrical connector of FIG. 8 being soldered to a main board.
Figure 11:
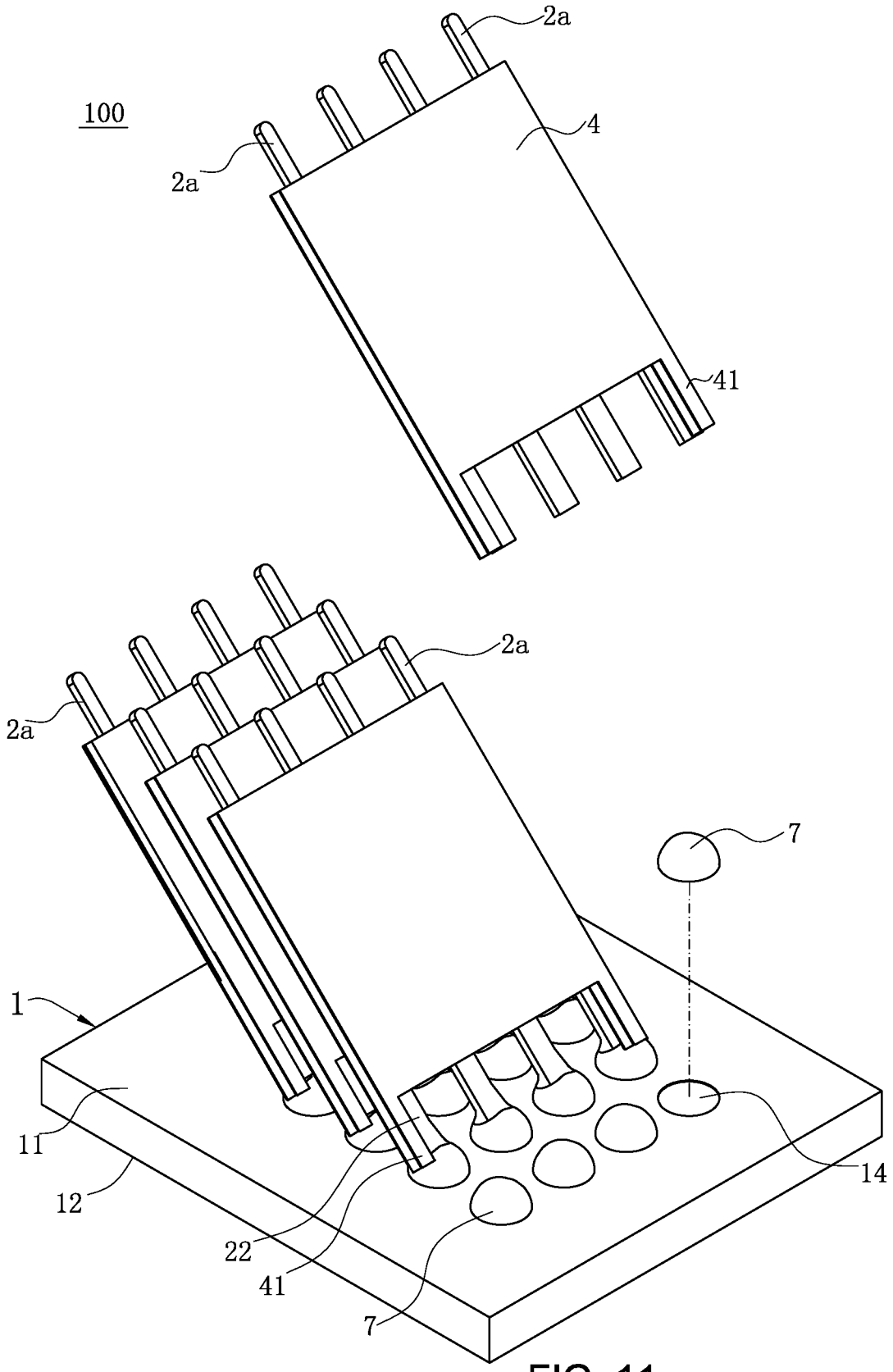
FIG. 11 is a partial schematic exploded view of an electrical connector according to a third embodiment of the present invention.
Figure 12:
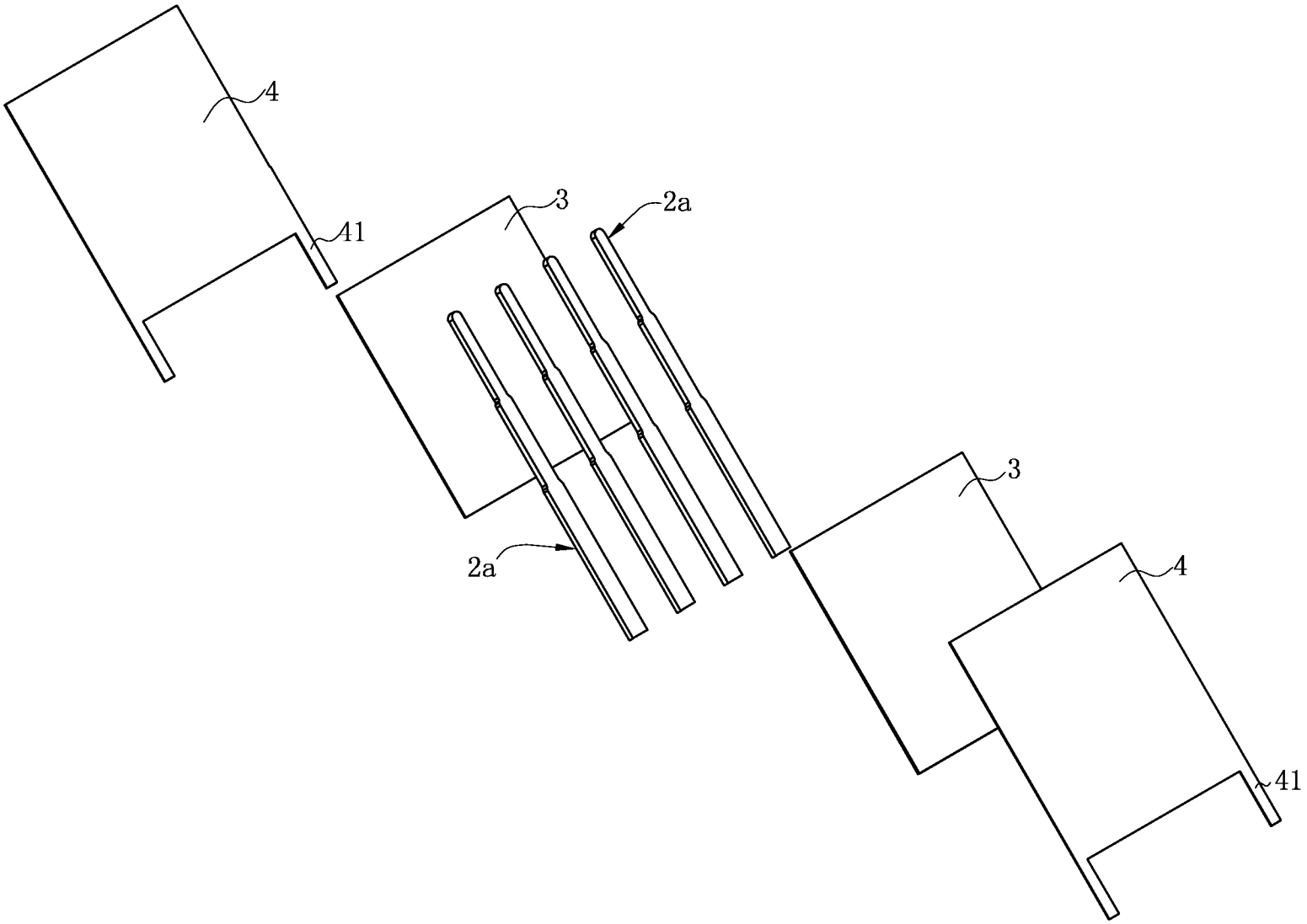
FIG. 12 is a schematic exploded view of a row of conductive terminals, an insulator, and a shielding body in FIG. 11.

FIG. 9 to FIG. 10 show an electrical connector 100 according to a third embodiment of the present invention, which is different from the first embodiment in that the conductive terminals 2 include a ground terminal 2*a*, and the shielding body 4 is provided with two soldering legs 41 respectively soldered to the same first solder 6 together with the ground terminal 2*a* correspondingly, such that the shielding body 4 is electrically connected to the substrate 1, thereby grounding the shielding body 4. Other structures of the second embodiment are the same as those of the first embodiment, and are not further elaborated herein.

In other embodiments, each shielding body 4 may also be provided with a ground pin correspondingly contacting the ground terminal 2*a*. The shielding body 4 is electrically connected to the substrate 1 through the ground terminal 2*a*, thereby grounding the shielding body 4.

To sum up, the electrical connector 100 according to certain embodiments of the present invention has the following beneficial effects:

(1) Each of the shielding bodies 4 is located between two adjacent rows of the conductive terminals 2, such that a shielding effect thereof is good, and electromagnetic interference between two adjacent rows of the conductive terminals 2 can be effectively shielded. Further, the shielding bodies 4 and the conductive terminals 2 are separated by the insulators 3, such that short-circuiting between the conductive terminals 2 and the shielding bodies 4 can be avoided. In addition, the shielding bodies 4 are fixed on the insulators 3, and the insulators 3 is attached to one row of the conductive terminals 2, such that no additional elements are required to fix the shielding body 4 and the insulator 3, thereby reducing costs.

(2) The conductive terminals 2, the insulators 3, and the shielding bodies 4 are all flat plate shaped, such that a manufacturing process is simple and costs are relatively low. In addition, the insulators 3 are easily attached to the conductive terminals 2, and the shielding bodies 4 can shield a larger area of the conductive terminals 2.

(3) Each shielding body 4 is located between the plate surfaces of two adjacent rows of the conductive terminals 2, such that the shielding body 4 shields the plate surfaces of the conductive terminals 2. Therefore, a shielding area is larger and a shielding effect is better.

(4) The conductive terminals 2 are soldered to the upper surface 11 of the substrate 1, such that a conventional insulating body for accommodating and fixing the conductive terminals 2 can be eliminated, thereby facilitating ultra-thinning of the electrical connector 100. The second solders 7 are located between the solder point area and the edge of the substrate 1, such that an electrical connection structure of the shielding bodies 4 and the substrate 1 does not affect arrangement of the conductive terminals 2.

(5) The shielding bodies 4 are electrically connected to the substrate 1 through the metal wire 8 to achieve grounding. Since the metal wire 8 is relatively soft, the metal wire 8 can be in good contact with the shielding bodies 4 as the conductive terminals 2 deform, and grounding stability thereof is high.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

a substrate, being a circuit board and electrically connected to a main board;

a plurality of rows of conductive terminals, electrically connected to and fixed on the substrate respectively;

a plurality of insulators, located above the substrate, wherein each of the insulators is not in direct contact with the substrate, and each of the insulators is correspondingly attached to one of the rows of the conductive terminals; and a plurality of shielding bodies, located above the substrate and electrically connected to the substrate, wherein the shielding bodies are located between two adjacent rows of the rows of the conductive terminals and correspondingly fixed on the insulators;

wherein the conductive terminals are fixed on the substrate.

2. The electrical connector according to claim 1, wherein the shielding bodies are located between plate surfaces of the two adjacent rows of the conductive terminals.

3. The electrical connector according to claim 1, wherein an upper surface of the substrate is provided with a solder point area, a plurality of solder points are arranged in the solder point area, and each of the conductive terminals is soldered to one of the solder points through a first solder; each of the shielding bodies is electrically connected to a second solder, and the second solder is located between the solder point area and an edge of the substrate.

4. The electrical connector according to claim 1, wherein two shielding bodies of the shielding bodies are located at two opposite sides of each of the rows of the conductive terminals, and the two shielding bodies are both soldered to a same solder to be soldered to an upper surface of the substrate.

5. The electrical connector according to claim 1, wherein each of the conductive terminals has a soldering portion soldered to an upper surface of the substrate, each of the shielding bodies has a soldering leg soldered to the upper surface of the substrate, and the soldering portion is parallel to the soldering leg.

6. The electrical connector according to claim 1, wherein the conductive terminals comprise a ground terminal, and the shielding bodies and the ground terminal are both soldered to a same solder.

7. The electrical connector according to claim 1, wherein the conductive terminals, the shielding bodies, and the insulators are all flat and are parallel to each other.

8. The electrical connector according to claim 1, wherein each of the conductive terminals has an elastic arm, and the insulators covering the elastic arm such that the shielding bodies shield the elastic arm.

9. The electrical connector according to claim 1, wherein a metal wire is correspondingly in contact with the shielding bodies, and the metal wire is soldered to an upper surface of the substrate.

10. The electrical connector according to claim 9, wherein the metal wire is in contact with a plate surface of each of the shielding bodies.

* * * * *